US007481516B2

(12) United States Patent
Jahana et al.

(10) Patent No.: US 7,481,516 B2
(45) Date of Patent: Jan. 27, 2009

(54) INKJET RECORDING APPARATUS AND INKJET RECORDING METHOD

(75) Inventors: Ryoki Jahana, Kawasaki (JP); Yoshitomo Marumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/020,970

(22) Filed: Jan. 28, 2008

(65) Prior Publication Data

US 2008/0204494 A1 Aug. 28, 2008

(30) Foreign Application Priority Data

Feb. 26, 2007 (JP) ..... 2007-046293

(51) Int. Cl.
*B41J 2/15* (2006.01)

(52) U.S. Cl. ..... 347/41

(58) Field of Classification Search ..... 347/12, 347/15, 41, 43, 100

See application file for complete search history.

(56) References Cited

U.S. PATENT DOCUMENTS 6,948,797 B2 * 9/2005 Shepherd et al. ..... 347/41
7,121,641 B2 * 10/2006 Nitta et al. ..... 347/15

FOREIGN PATENT DOCUMENTS

JP 55-113573 9/1980

* cited by examiner

*Primary Examiner*—Lamson D Nguyen
(74) *Attorney, Agent, or Firm*—Canon U.S.A., Inc., IP Division

(57) ABSTRACT

In an inkjet recording apparatus and an inkjet recording method, recording on a first unit region, of unit regions provided on a recording medium, is performed by scanning a recording head an even number of times over the first unit region, and recording on a second unit region adjacent to the first unit region is performed by scanning the recording head an odd number of times over the second unit region. The last of the scanning motions of the recording head over the first and second unit regions is made in a first direction.

8 Claims, 6 Drawing Sheets

INKJET RECORDING APPARATUS AND INKJET RECORDING METHOD

BACKGROUND OF THE INVENTION

1. Field of the Invention

The present invention relates to an inkjet recording apparatus and an inkjet recording method for recording images with an inkjet recording head.

2. Description of the Related Art

In inkjet recording apparatuses that perform recording on a recording medium by discharging ink from nozzles arrayed in a recording head, multipass recording is widely used in order to improve the recording image quality. Multipass recording is performed by alternately repeating a recording scanning operation and a conveying operation. A carriage having a recording head reciprocates for recording in the recording scanning operation, and a recording medium is conveyed by a predetermined amount in a direction orthogonal to the reciprocating direction of the carriage in the conveying operation. In multipass recording, unit regions (bands) of an image are sequentially recorded on the recording medium by alternately repeating the recording scanning operation and the conveyance operation. Japanese Patent Laid-Open No. 55-113573 discloses a two-way recording method in which recording is performed by both forward and backward scanning motions of a recording head.

Unfortunately, when two-way recording is performed by the conventional multipass recording method, band-like recorded unevenness may occur. Band-like recorded unevenness is caused when the glossiness and tone of color differ among the unit regions because the order in which inks are printed differs among the unit regions.

This problem may be more apparent particularly when recording is performed with pigment inks, since pigment ink printed later may cover pigment ink printed previously, that is, the later recorded pigment ink may remain more easily on a surface of the recording medium than the previously recorded pigment ink. Therefore, the glossiness and tone of color of the later printed pigment ink tend to be dominant. That is, in two-way recording with pigment inks, the order in which the pigment inks are printed in the last pass differs among the unit regions, and consequently, band-like recorded unevenness sometimes appears markedly.

SUMMARY OF THE INVENTION

An embodiment of the present invention is directed to an inkjet recording apparatus and an inkjet recording method that can prevent or at least mitigate the image quality from being reduced by band-like recorded unevenness.

A recording apparatus according to an aspect of the present invention includes a recording unit having nozzle arrays corresponding to first and second inks, and configured to perform recording by discharging the first ink and the second ink in that order during a first scanning motion in a first direction, and discharging the second ink and the first ink in that order during a second scanning motion in a second direction; a conveying unit configured to convey a recording medium in a direction orthogonal to the first and second directions by an amount less than the width of the nozzle arrays, the recording medium including unit regions each having a width less than the width of the nozzle arrays; and a recording control unit configured to perform recording on a first unit region of the unit regions by scanning the recording unit over the first unit region an even number of times, and to perform recording on a second unit region adjacent to the first unit region by scanning the recording unit over the second unit region an odd number of times. The last of the scanning motions of the recording unit over the first and second unit regions is made in the first direction.

An inkjet recording method according to another aspect of the present invention performs recording by discharging a first ink and a second ink in that order from nozzle arrays provided in a recording head corresponding to the first and second inks during a first scanning motion in a first direction, and discharging the second ink and the first ink in that order from the nozzle arrays during a second scanning motion in a second direction. The inkjet recording method includes performing recording on a first unit region, of unit regions of a recording medium each having a width less than the width of the nozzle arrays, by scanning the recording head an even number of times over the first unit region; performing recording on a second unit region adjacent to the first unit region by scanning the recording head an odd number of times over the second unit region; and conveying the recording medium between the first scanning motion and the second scanning motion in a direction orthogonal to the first and second directions by an amount less than the width of the nozzle arrays. The last of the scanning motions of the recording head over the first and second unit regions is made in the first direction.

An inkjet recording method according to a further aspect of the present invention performs recording on a plurality of unit regions of a recording medium by discharging a first ink and a second ink from corresponding nozzle arrays arranged in a scanning direction of a recording head onto the unit regions during a plurality of scanning motions including a forward scanning motion and a backward scanning motion. The inkjet recording method includes discharging the first ink and the second ink in that order from the nozzle arrays onto the unit regions during the forward scanning motion; discharging the second ink and the first ink in that order from the nozzle arrays onto the unit regions during the backward scanning motion; and conveying the recording medium between the forward scanning motion and the backward scanning motion in a direction orthogonal to the first and second scanning motions by an amount corresponding to the width of the unit regions. Nozzles used in the forward scanning motion are different from nozzles used in the backward scanning motion so that the recording order of the first ink and the second ink in the last of the scanning motions of the recording head is constant among the unit regions.

Further features of the present invention will become apparent from the following description of exemplary embodiments with reference to the attached drawings.

DESCRIPTION OF THE EMBODIMENTS

Exemplary embodiments of the present invention will be described in detail below with reference to the drawings.

In this specification, the term "recording" (hereinafter also referred to as "printing") means not only formation of significant information, such as characters and figures, but also formation of a wide range of objects, such as images, designs, and patterns, on a recording medium, or processing of the recording medium, regardless of whether the formed objects are significant or insignificant, and whether the objects are apparent to be visually perceivable by persons.

The term "recording medium" includes not only paper used in general recording apparatuses, but also other materials capable of accepting ink, such as cloth, a plastic film, a metallic plate, glass, ceramics, wood, and leather.

Further, the term "ink" should be widely interpreted like the above definition of "recording", and includes liquids to be applied to a recording medium so as to form images, designs, patterns, etc., to process the recording medium, or to treat the ink. Treatment of the ink includes, for example, solidification or insolubilization of coloring materials in the ink applied to the recording medium.

Figure 1:
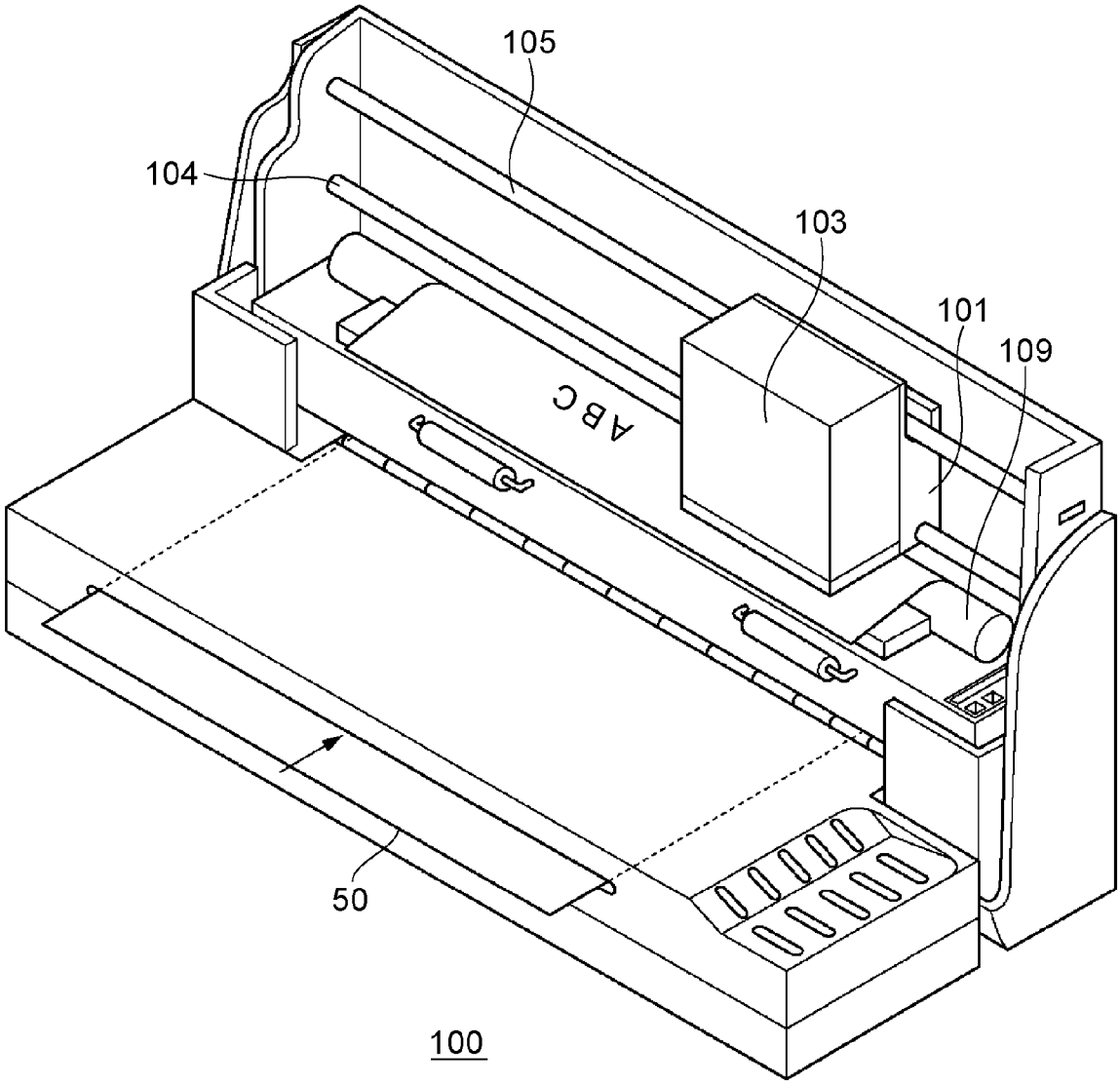
FIG. 1 is a schematic perspective view of an inkjet recording apparatus according to an exemplary embodiment of the present invention.

FIG. 1 is a schematic perspective view of an inkjet recording apparatus (hereinafter also referred to as a recording apparatus) 100 according to an exemplary embodiment of the present invention. Referring to FIG. 1, a carriage 101 reciprocates for scanning in a recordable region along guide shafts 104 and 105. A recording head unit 103 includes a recording head 1 (see FIG. 5), and stores different color inks. The recording head unit 103 moves in the recordable region with scanning of the carriage 101, and performs recording by discharging ink according to image data. A conveying roller 109 conveys a recording medium 50 in a direction orthogonal to the scanning direction of the carriage 101.

Figure 5:
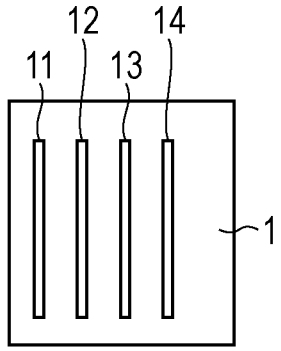
FIG. 5 is an explanatory view showing a configuration of a recording head in the exemplary embodiment.

FIG. 5 is a schematic view of the recording head 1, as viewed from the side of a nozzle surface. In this exemplary embodiment, the recording head 1 includes nozzle arrays 11 to 14 corresponding to four colors of yellow, magenta, cyan, and black.

Figure 6:
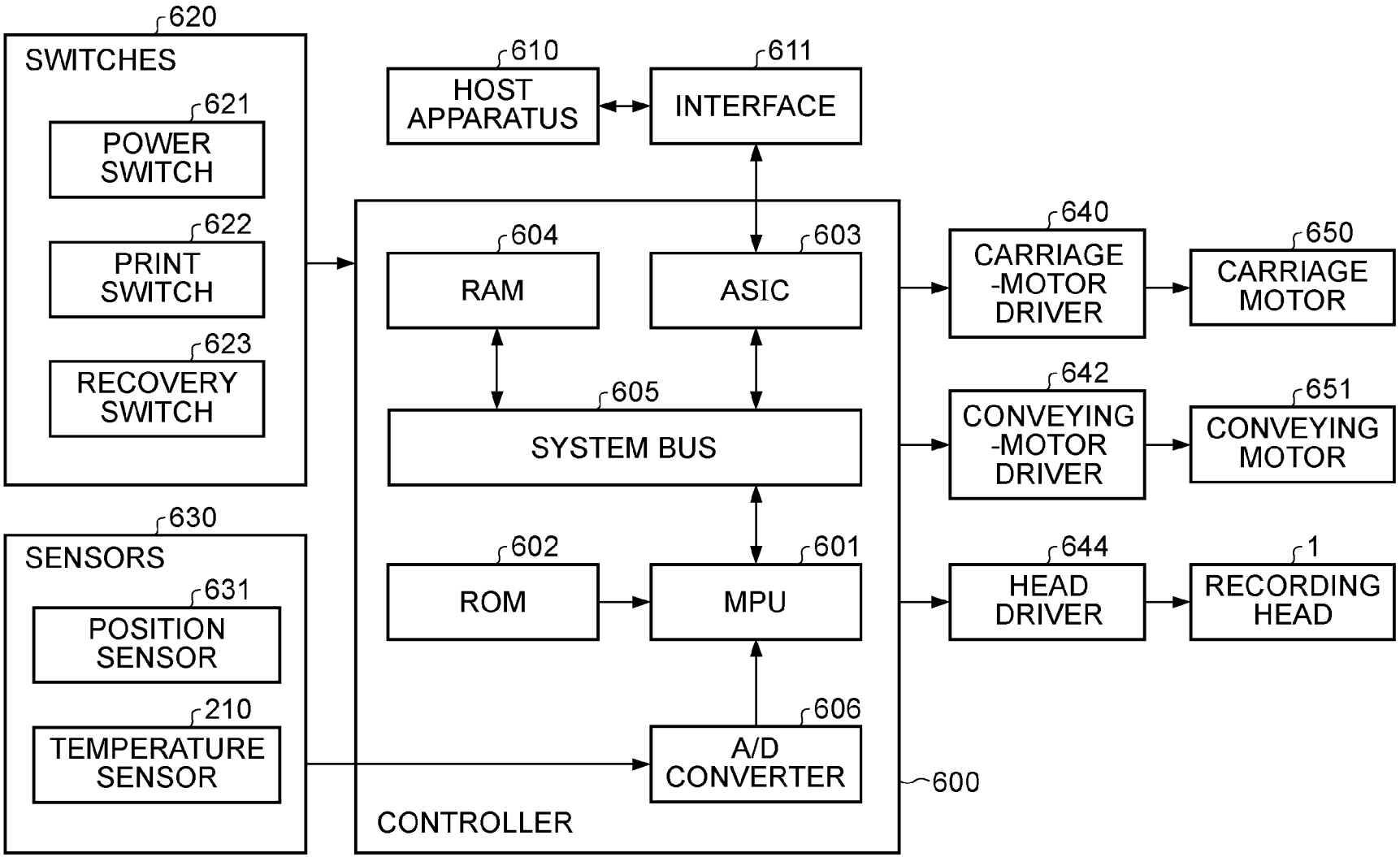
FIG. 6 is a block diagram showing a control configuration of the inkjet recording apparatus coupled to a host apparatus.

FIG. 6 is a block diagram showing a control configuration of the recording apparatus 100 shown in FIG. 1 coupled to a host apparatus 610.

As shown in FIG. 6, a controller 600 includes an MPU 601, and a ROM 602 that stores programs corresponding to a below-described control sequence, a required table, and other fixed data. The controller 600 also includes an application specific integrated circuit (ASIC) 603 that generates control signals for controlling a carriage motor 650, a conveying motor 651, and the recording head 1. The controller 600 also includes a RAM 604 including an image-data expansion region and a work area for executing the program, and a system bus 605 that mutually connects the MPU 601, the ASIC 603, and the RAM 604 so that data can be exchanged thereamong. The controller 600 further includes an A/D converter 606 that converts analog signals input from below-described sensors into digital signals, and supplies the digital signals to the MPU 601.

In FIG. 6, an image data supply source, such as a computer, 610 is generically named a host apparatus. Image data, commands, status signals, etc. are exchanged between the host apparatus 610 and the recording apparatus 100 via an interface (I/F) 611.

Switches 620 include switches that receive commands input by the operator, for example, a power switch 621, a print switch 622 for instructing the start of printing, and a recovery switch 623 for instructing the start of a recovery operation. Sensors 630 include a position sensor 631 such as a photocoupler, and a temperature sensor 210.

A carriage-motor driver 640 drives the carriage motor 650, and a conveying-motor driver 642 drives the conveying motor 651. A head driver 644 drives the recording head 1.

In this exemplary embodiment, so-called four-pass recording, of multipass recording, is performed so that an image in each unit region of a recording medium is completed by four scanning runs.

Figure 2:
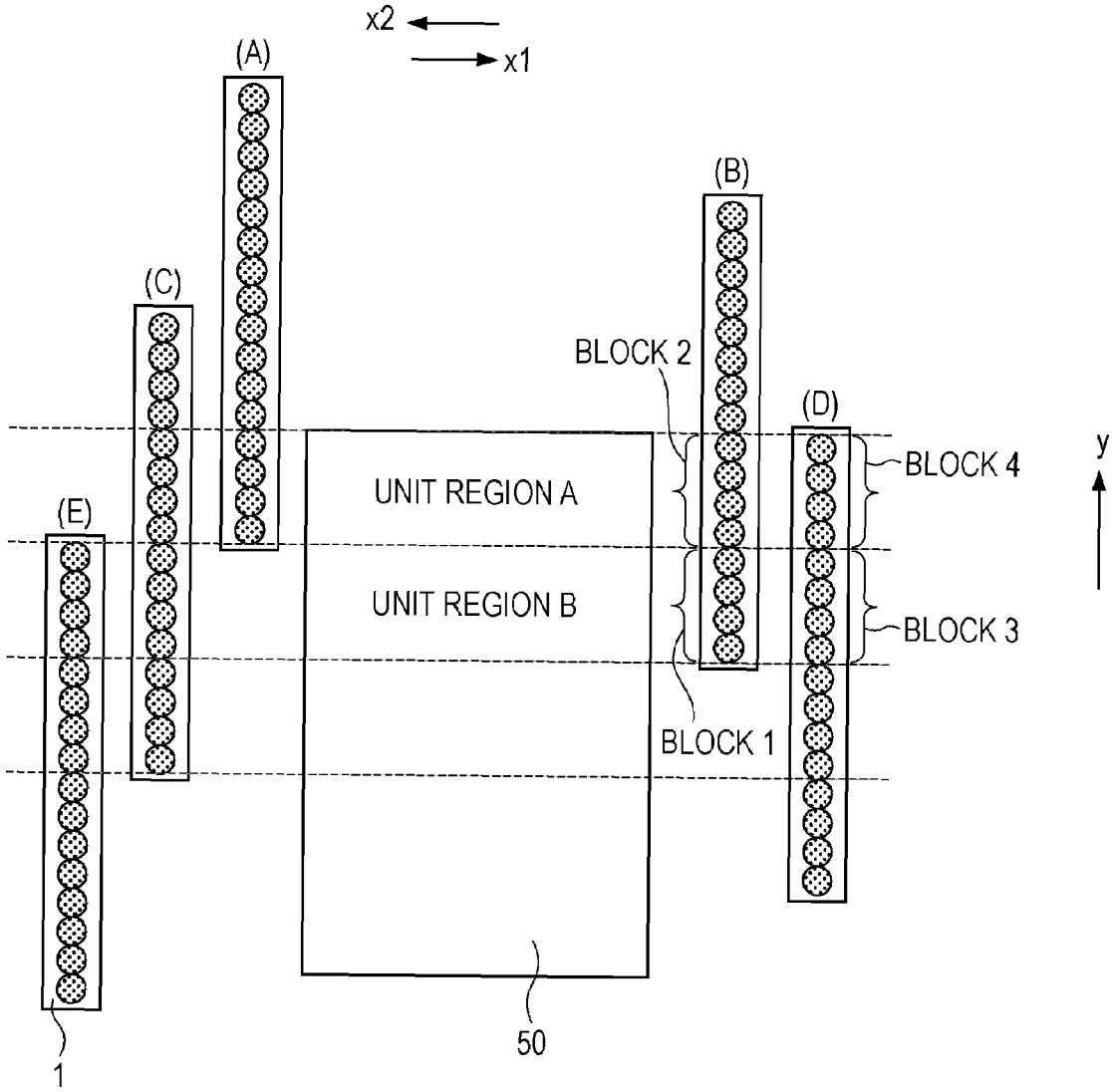
FIG. 2 is an explanatory view showing a multipass recording method.

Multipass recording will now be described with reference to four-pass recording as an example. FIG. 2 shows the relationship between the recording medium 50 and the recording head 1 provided when recording on unit regions A and B is performed by four-pass two-way recording. Each nozzle array provided in the recording head 1 is divided into four blocks 1 to 4. For simple explanation, a case in which the recording head 1 includes only one nozzle array will now be described with reference to FIG. 2.

In FIG. 2, (A) shows the position of the recording head 1 relative to the recording medium 50 in a first scanning run. In this case, the recording head 1 performs the first pass printing for a unit region A by discharging ink from the block 1 of the nozzle array while scanning in the x1-direction. When the first scanning run is finished, the recording medium 50 is conveyed by a predetermined amount in the y-direction. Further, (B) shows the relative position of the recording head 1 in a second scanning run subsequent to the first scanning run. In the second scanning run, the recording head 1 performs the second pass printing for the unit region A and the first pass printing for a unit region B by discharging ink from the blocks 1 and 2 while scanning in the x2-direction. The recording medium 50 is then conveyed by the predetermined amount in the y-direction. Similarly, in a third scanning run shown by (C) in FIG. 2, the recording head 1 performs the third pass printing for the unit region A and the second pass printing for the unit region B by discharging ink from the blocks 2 and 3 while scanning in the x1-direction. In the fourth scanning run shown by (D) in FIG. 2, the recording head 1 performs the fourth pass printing for the unit region A and the third pass printing for the unit region B by discharging ink from the blocks 3 and 4 while scanning in the x2-direction. In the fifth scanning run shown by (E), the recording head 1 performs the fourth pass printing for the unit region B by discharging ink from the block 4 while scanning in the x1-direction.

That is, printing of the unit region A starts with the first scanning run in the forward direction x1. Subsequently, the second scanning run in the backward direction, the third scanning run in the forward direction, and the fourth scanning run in the backward direction are made in that order for printing. In contrast, printing of the unit region B adjacent to the unit region A starts with the first scanning run in the backward direction x2. Subsequently, the second scanning run in the forward direction, the third scanning run in the backward direction, and the fourth scanning run in the forward direction are made in that order for printing. In this way, in the known two-way multipass recording, the scanning direction in the last (fourth) pass differs between the unit regions. Therefore, the ink recording order in the last pass, which has the greatest influence on the glossiness and tone of color of the unit regions, differs between the unit regions.

Figure 7:
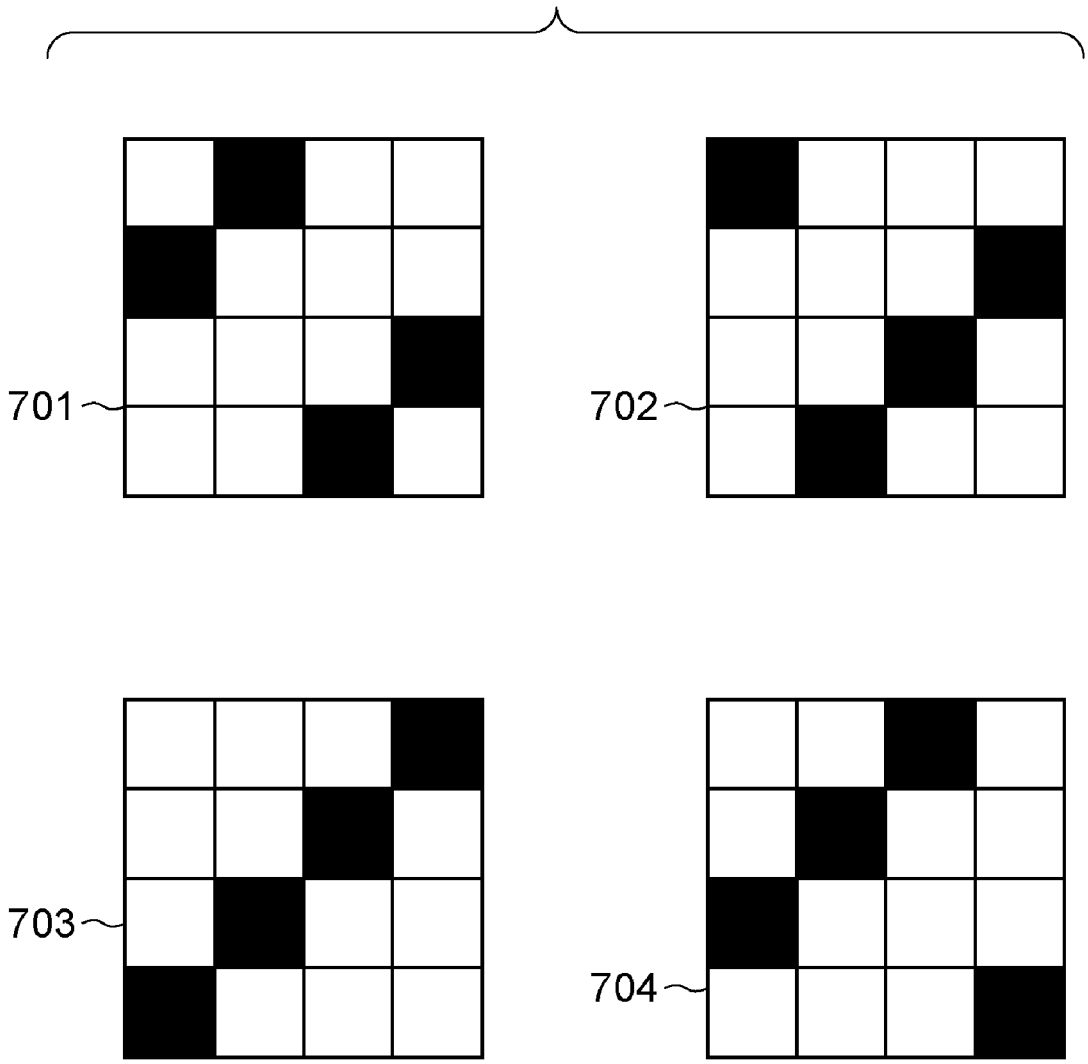
FIG. 7 is an explanatory view showing examples of mask patterns used in four-pass recording.

FIG. 7 shows examples of mask patterns used in four-pass recording. In FIG. 7, reference numerals 701, 702, 703, and 704 denote mask patterns, respectively, for the first pass, the second pass, the third pass, and the fourth pass. Each of the mask patterns 701 to 704 corresponds to a 4 by 4 matrix of pixels. Among pixels determined to be recorded in each pass printing according to image data, pixels aligned with black recording pixel portions of the mask pattern are defined as recording pixels.

The rate of black recording pixels defined as recording pixels in a predetermined size of mask pattern (4 by 4 pixels) is defined as an allowable rate of recording of the mask pattern. That is, each mask pattern shown in FIG. 7 has an allowable rate of recording of 25%.

The two-way multipass recording method according to this exemplary embodiment will be described further below.

Figure 3A:
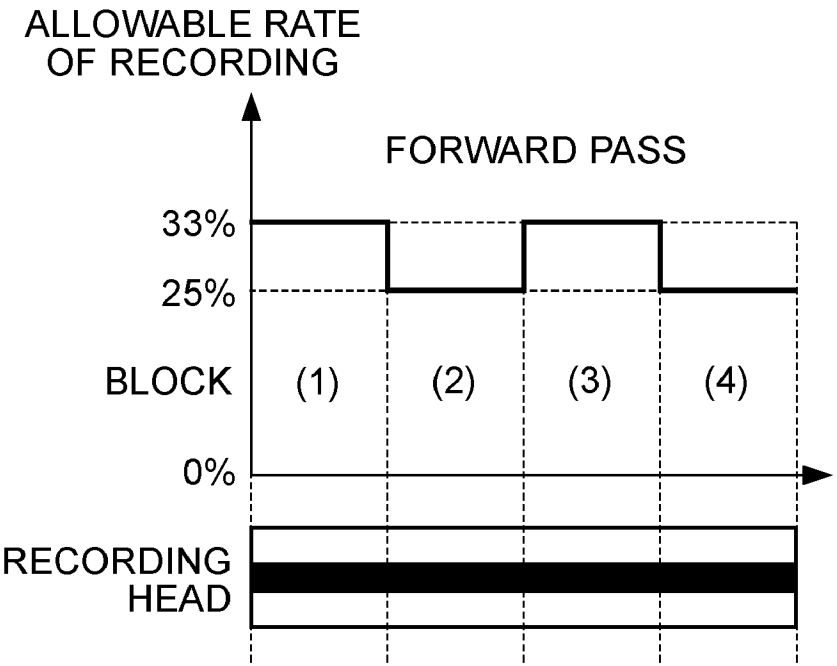
FIG. 3 is a chart showing the recording rates in a plurality of blocks of a recording head obtained when recording is performed with a mask pattern used as a mask.
Figure 3B:
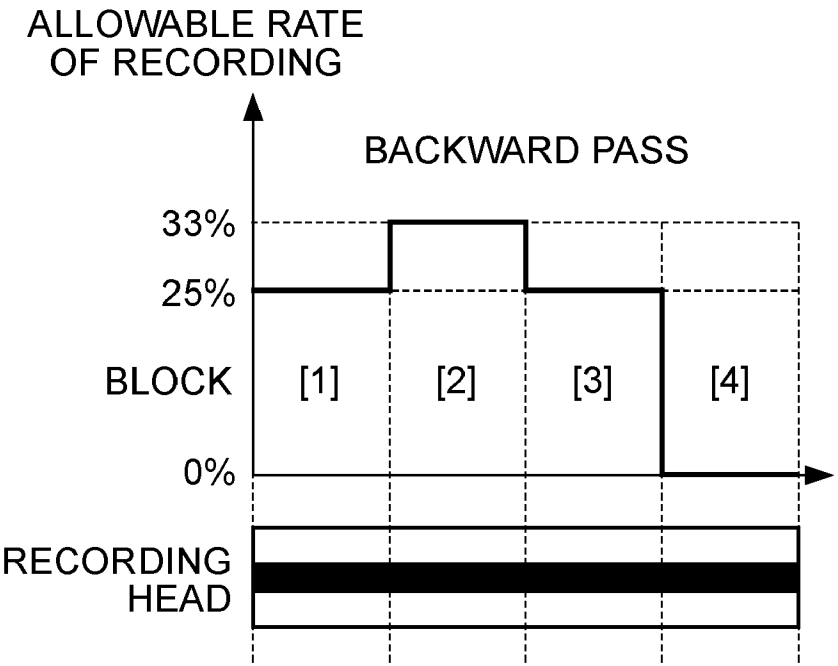

FIG. 3 shows the allowable rates of recording of the mask patterns adopted in the blocks 1 to 4 in the forward scanning run (x1) and the backward scanning run (x2) of four-pass recording according to this exemplary embodiment.

The unit regions A and B are recorded in the following sequences. In the unit region A, the first pass printing is performed by the block 1 in the forward direction (x1), and the second pass printing is performed by the block 2 in the backward direction (x2). Then, the third pass printing is performed by the block 3 in the forward direction (x1), and the fourth pass printing is performed by the block 4 in the backward direction (x2). The first to third pass printing operations are performed with mask patterns each having an allowable rate of recording of 33%, and the fourth pass printing is performed with a mask pattern having an allowable rate of recording of 0%, that is, the fourth pass printing is not performed. In this way, image data to be recorded in the fourth pass printing is complemented by another pass printing so as to complete an image. That is, the sum of the allowable rates of recording is 100% in each band.

In the unit region B, the first pass printing is performed by the block 1 in the backward direction (x2), and the second pass printing is performed by the block 2 in the forward direction (x1). Then, the third pass printing is performed by the block 3 in the backward direction (x2), and the fourth pass printing is performed by the block 4 in the forward direction (x1). In this way, the first to fourth pass printing operations are performed with mask patterns each having an allowable rate of recording of 25%.

In this exemplary embodiment, the mask pattern having an allowable rate of recording of 0% is used in the last pass for the unit region A so as not to perform printing. Therefore, unit regions for four-pass printing and unit regions for three-pass printing are alternately provided, like the unit regions B in which an image is completed by four-pass printing and the unit regions A in which an image is completed by three-pass printing.

Figure 4:
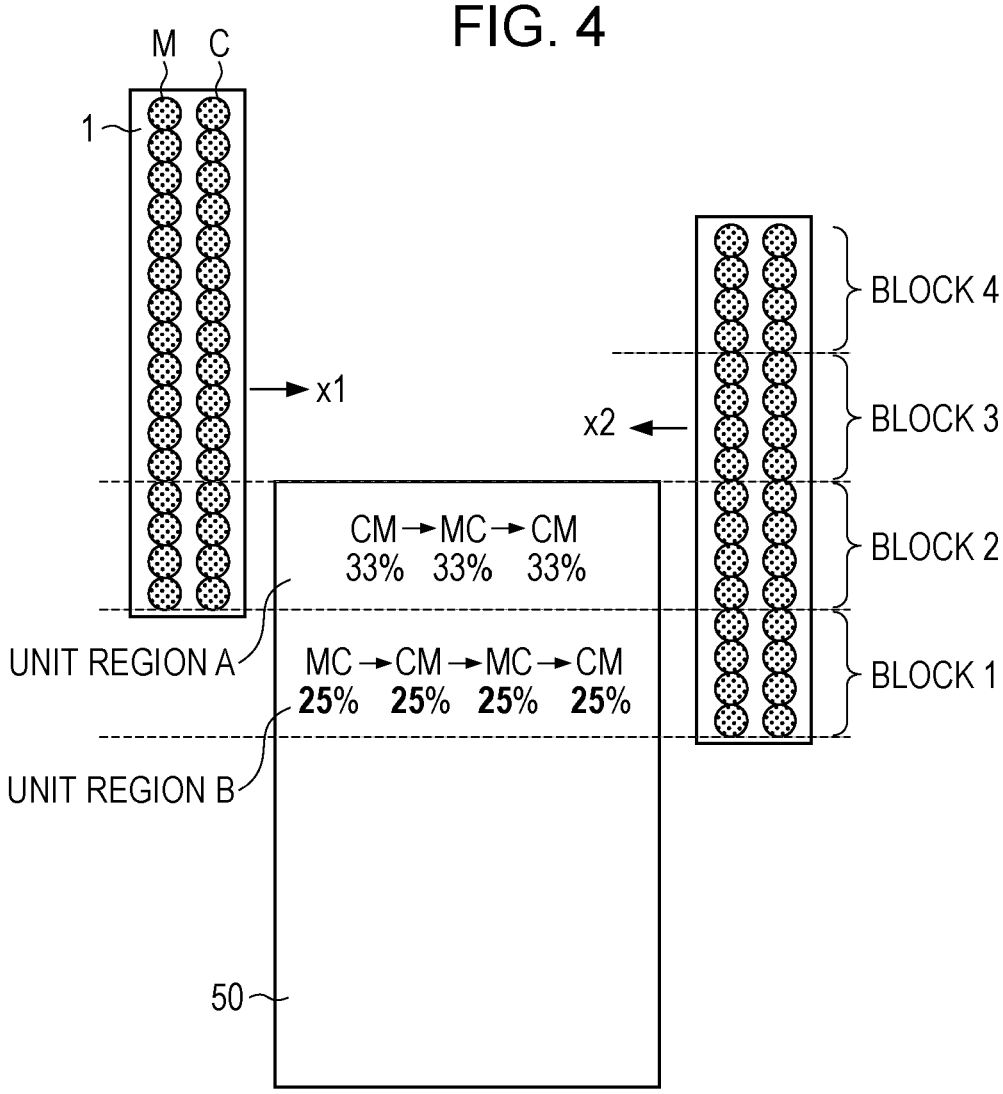
FIG. 4 is a schematic view showing the recording order for a secondary color.

FIG. 4 schematically shows the ink recording order in which the inks are printed when a secondary color is printed by a two-way multipass recording method in this exemplary embodiment.

FIG. 4 shows a case in which a secondary color is formed by magenta (M) and cyan (C) inks each containing pigment as a coloring material. As shown in FIG. 4, one nozzle array for cyan ink and one nozzle array for magenta ink are disposed in parallel in the recording head 1. Cyan ink and magenta ink are printed in that order in the forward scanning run (x1), and magenta ink and cyan ink are printed in that order in the backward scanning run (x2). In a unit region in which recording starts with a forward scanning run, recording is not performed in a backward scanning run for the fourth pass printing, but ends with a forward scanning run for the third pass printing. That is, in this unit region, magenta and cyan inks are printed with mask patterns each having an allowable rate of recording of 33% in the first to third pass printing operations, and a mask pattern having an allowable rate of recording of 0% is used so as not to perform the fourth pass printing. Since the third pass printing serves as the last pass printing in this unit region, the last scanning run is made in the forward direction, and cyan ink and magenta ink are printed in that order in the last pass printing. In contrast, in a unit region in which recording starts with a backward scanning run, recording ends with a backward scanning run for the fourth pass printing. That is, in this unit region, recording is performed with mask patterns each having an allowable rate of recording of 25% in the first to fourth pass printing operations. Therefore, the last scanning run is made in the forward direction, and cyan ink and magenta ink are printed in that order in the lass pass printing.

According to the above-described recording method of the exemplary embodiment, the scanning direction for the last pass printing, which has the greatest influence on the glossiness and tone of color, can be the same in all unit regions, and the ink recording order in the last pass can also be the same in all unit regions. That is, it is possible to reduce the influence of band-like recorded unevenness caused by differences in glossiness and tone of color among the unit regions.

In the above description, the sum of the allowable rates of recording of the mask patterns is 100%. However, when the diameter of each recorded dot is small with respect to the resolution of the recording image, the sum of the allowable rates of recording of the mask patterns is sometimes set to be 100% or more in order to increase the image density. The present invention is also applicable to this case in which the sum of the allowable rates of recording of the mask patterns is 100% or more.

The scanning direction in which a mask pattern having an allowable rate of recording of 0% is used in the last pass is not limited to the forward direction, and may be the backward direction. Further, all nozzle arrays do not need to adopt the same mask patterns, and may adopt different mask patterns. While the mask pattern used in the last pass for one of the unit regions has an allowable rate of recording of 0%, the allowable rate of recording may be about several percents.

According to an embodiment of the present invention, the number of recording passes for each unit region in multipass recording is not limited to three or four as in the above-described embodiment. That is, one of two adjacent regions can be completed by an odd number of scanning runs, and the other unit region can be completed by an even number of scanning runs. For example, two adjacent unit regions can be recorded by three-pass recording and eight-pass recording. However, it is preferable that a difference in number of scanning runs between the adjacent unit regions be one as in the above-described exemplary embodiment. This is because the differences in glossiness and tone of color decrease as the number difference decreases.

Since dye ink printed later more deeply infiltrates into the recording paper than dye ink recorded previously, the characteristic of the previously recorded ink is dominant in the image. Therefore, in a recording apparatus using dye ink, it is preferable that the allowable rate of recording of a mask pattern used in the first pass printing for one of adjacent unit regions be set at 0%.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2007-046293 filed Feb. 26, 2007, which is hereby incorporated by reference herein in its entirety.

What is claimed is:

1. A recording apparatus comprising:

a recording unit having nozzle arrays corresponding to first and second inks, and configured to perform recording by discharging the first ink and the second ink in that order during a first scanning motion in a first direction, and discharging the second ink and the first ink in that order during a second scanning motion in a second direction;

a conveying unit configured to convey a recording medium in a direction orthogonal to the first and second directions by an amount less than the width of the nozzle arrays, the recording medium including unit regions each having a width less than the width of the nozzle arrays; and a recording control unit configured to perform recording on a first unit region of the unit regions by scanning the recording unit over the first unit region an even number of times, and to perform recording on a second unit region adjacent to the first unit region by scanning the recording unit over the second unit region an odd number of times, wherein the last of the scanning motions of the recording unit over the first and second unit regions is made in the first direction.

2. The recording apparatus according to claim 1, wherein the conveying unit conveys the recording medium in a direction orthogonal to the first and second directions by an amount corresponding to the width of the unit regions after the first scanning motion in the first direction is completed and before the second scanning motion in the second direction is started, and the conveying unit conveys the recording medium in a direction orthogonal to the first and second directions by an amount corresponding to the width of the unit regions after the second scanning motion in the second direction is completed and before the first scanning motion in the first direction is started.

3. The recording apparatus according to claim 1, wherein a difference between a number of scanning motions of the recording head over the first unit region and the number of scanning motions of the recording over the second unit region is one.

4. The recording apparatus according to claim 1, wherein at least one of the first ink and the second ink contains pigment as a coloring material.

5. An inkjet recording method that performs recording by discharging a first ink and a second ink in that order from nozzle arrays provided in a recording head corresponding to the first and second inks during a first scanning motion in a first direction, and discharging the second ink and the first ink in that order from the nozzle arrays during a second scanning motion in a second direction, the inkjet recording method comprising:

performing recording on a first unit region, of unit regions of a recording medium each having a width less than the width of the nozzle arrays, by scanning the recording head an even number of times over the first unit region;

performing recording on a second unit region adjacent to the first unit region by scanning the recording head an odd number of times over the second unit region; and conveying the recording medium in a direction orthogonal to the first and second directions by an amount less than the width of the nozzle arrays, wherein the last of the scanning motions of the recording head over the first and second unit regions is made in the first direction.

6. The inkjet recording method according to claim 5, wherein a difference between the number of scanning motions of the recording head over the first unit region and the number of scanning motions of the recording head over the second unit region is 1.

7. The inkjet recording method according to claim 5, wherein the first and second inks include pigment ink.

8. An inkjet recording method that performs recording on a plurality of unit regions of a recording medium by discharging a first ink and a second ink from corresponding nozzle arrays arranged in a scanning direction of a recording head onto the unit regions during a plurality of scanning motions including a forward scanning motion and a backward scanning motion, the inkjet recording method comprising:

discharging the first ink and the second ink in that order from the nozzle arrays onto the unit regions during the forward scanning motion;

discharging the second ink and the first ink in that order from the nozzle arrays onto the unit regions during the backward scanning motion; and conveying the recording medium in a direction orthogonal to the scanning direction by an amount corresponding to the width of the unit regions, wherein nozzles used in the forward scanning motion are different from nozzles used in the backward scanning motion so that the recording order of the first ink and the second ink in the last of the scanning motions of the recording head is constant among the unit regions.

* * * * *